United States Patent [19]

Paepke

[11] 4,102,509

[45] Jul. 25, 1978

[54] FILAMENT FEEDING APPARATUS AND METHOD

[76] Inventor: Horst Paepke, Fasanenweg 30, 7407 Rottenburg, Neckar, Fed. Rep. of Germany

[21] Appl. No.: 775,586

[22] Filed: Mar. 8, 1977

[30] Foreign Application Priority Data

Mar. 13, 1976 [DE] Fed. Rep. of Germany ..... 2610709

[51] Int. Cl.[2] ..... B65H 51/24; B65H 51/26

[52] U.S. Cl. ..... 242/47.04; 242/47.05

[58] Field of Search ..... 242/47.04, 47.05, 47.01, 242/47.08, 47.09, 47.12, 47.13; 28/71.3, 59, 59.5; 66/132 R

[56] References Cited

U.S. PATENT DOCUMENTS

| | | | |
|---|---|---|---|
| 2,091,285 | 8/1937 | Knebusch | 242/47.05 |
| 2,244,119 | 6/1941 | Samerdyke | 242/47.05 |
| 2,289,390 | 7/1942 | Torrence et al. | 242/47.05 |

FOREIGN PATENT DOCUMENTS

| | | | |
|---|---|---|---|
| 967,095 | 3/1950 | France | 242/47.05 |
| 493,965 | 10/1938 | United Kingdom | 242/47.05 |

*Primary Examiner*—Stanley N. Gilreath
*Attorney, Agent, or Firm*—Michael J. Striker

[57] ABSTRACT

A main array of main rods parallel to and centered on a fixed main axis is supported for rotation about this main axis. Similarly a skew array of skew rods substantially parallel to and centered on a skew axis extending at an acute angle to the main axis is supported for rotation about the skew axis with the skew rods interleaved with the main rods. At least one of the arrays of rods is carried on a support formed between the rods with throughgoing holes in which are loosely received the free ends of the other array of rods. Thus when either of the arrays of rods is rotated about its respective axis the free ends will operatively engage the support at these holes and rotationally entrain the other array, thereby rotating the main and skew arrays so as to define relatively inclined main and skew orbits. A filament is fed tangentially to the orbits and withdrawn tangentially therefrom, after being urged axially along these orbits by their relative inclinations. An eccentric is provided for varying the spacing of the skew axis relative to the main axis in a direction perpendicular to the main axis.

12 Claims, 2 Drawing Figures

FILAMENT FEEDING APPARATUS AND METHOD

CROSS-REFERENCE TO RELATED APPLICATIONS:

This application is related to my copending patent applications Ser. Nos. 458,288 , now U.S. Pat. No. 3,918,275, and 562,242, now U.S. Pat. No. 4,017,038.

BACKGROUND OF THE INVENTION

The present invention relates to a method of and an apparatus for advancing a filament. More particularly this invention concerns a yarn feeder usable for pulling a yarn off a supply, spinning apparatus, or similar source under a relatively constant tension.

Such a feeding apparatus is known which is rotatable about a main axis and which has an outer surface formed partially as a cylinder centered on this main axis and partially as a cylinder centered on a skew axis inclined at an acute angle to the main axis. The filament or yarn is fed tangentially to this rotating structure so as to initially impinge the rotating structure at the portion thereof centered on the skew axis, and is withdrawn tangentially from the arrangement of the surface portion centered on the main axis. The relative inclination of these two surface portions to each other insures that the filament will be urged axially along the assembly as it is wound thereon. This particular arrangement insures that the turns of the filament do not rub against each other and chafe. In particular when unspun yarns are being used such chafing can lead to filament breakage.

In one particular structure for achieving this end the two surfaces are formed by respective annular arrays of parallel rods that are angularly interleaved. Relatively complex bearing, support, and drive structure is provided to rotate the two arrays and achieve the desired results. Thus such arrangements are quite expensive. In addition lint build-up in such arrangements frequently leads to clogging and breakdown.

It is also known to form the rotating structure at least partially of radially and/or axially oscillating elements that insure the axial advance of the turns of the filament being advanced along the rotating drum. These devices are particularly complex and trouble prone, and when the tracks of the displaceable elements become fouled with the lint always present around such devices these arrangements invariably malfunction.

Prior-art devices can be seen in U.S. Pat. No. 3,225,446, German Pat. No. 1,635,899 and German Offenlegungschriften Nos. 1,942,062 and 2,126,845.

SUMMARY OF THE INVENTION

It is therefore an object of the present invention to provide an improved method of and apparatus for advancing a filament.

Another object is the provision of such an apparatus which is relatively simple in construction and inexpensive to manufacture.

Another object is to provide such a method and apparatus which can readily be adjusted to advance different yarns or filaments axially at a different rate.

A further object is the provision of an improved method and apparatus for advancing a filament which overcomes the above-given and other disadvantages.

These objects are attained according to the present invention in an arrangement wherein a main array of main rods substantially parallel to and centered on a fixed main axis are supported for rotation about the main axis. Similarly a skew array of skew rods substantially parallel to and centered on a skew axis extending at an acute angle to the main axis are supported for rotation about the skew axis with the skew rods interleaved with the main rods. These skew rods are operatively engaged with the main rods. Thus rotationally driving of the main array of main rods about the main axis so that the main rods define a substantially cylindrical main orbit centered on the main axis causes the skew rods operatively engaged with the main rods to rotate about the skew axis so that these skew rods define a substantially cylindrical skew orbit inclined at an acute angle to the main orbit and centered on the skew axis. Thus a filament fed tangentially to the orbits and withdrawn tangentially therefrom will be advanced axially along the orbits.

In accordance with this invention each of the arrays of rods is carried on a respective support. At least one of the arrays of rods has free ends which are loosely received in holes formed in the support for the other array of rods. Thus the two arrays of rods are operatively rotationally interengaged by the fitting of the free rod ends in the support holes.

According to yet another feature of this invention means is provided for displacing the skew axis transversely to the main axis. This means then would be constituted as an eccentric rotatable about an axis parallel to the main axis and operatively engaged with the skew axis so that when rotated it laterally displaces this skew axis.

In accordance with further features of this invention the apparatus includes a main base carrying a main bearing which defines the main axis. The main support is constituted by a rod received in the main bearing and carrying a disk on which the main rods are mounted. A skew base is pivotal on the main base and carries a skew bearing in which is journalled the skew support constituted as a plate carrying the skew rods. The skew support and skew base are formed with central throughgoing holes through which passes the rod forming part of the main support. At one end this main rod carries the plate of the main support and at its other end it carries a sheave or pulley against whose surface engages a belt constituting with the pulley the drive means of this invention.

Thus the system according to this invention is extremely simple in operation. Merely rotating the main array entrains the skew array by means of the main rods and insures synchronous rotation of the two arrays. Similarly provision of means for displacing the skew axis, although relatively simple and adding little to the construction cost of the apparatus, does make it possible to adjust the arrangement for reverse rotation or use with different yarns.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF A PREFERRED EMBODIMENT

Figure 1:
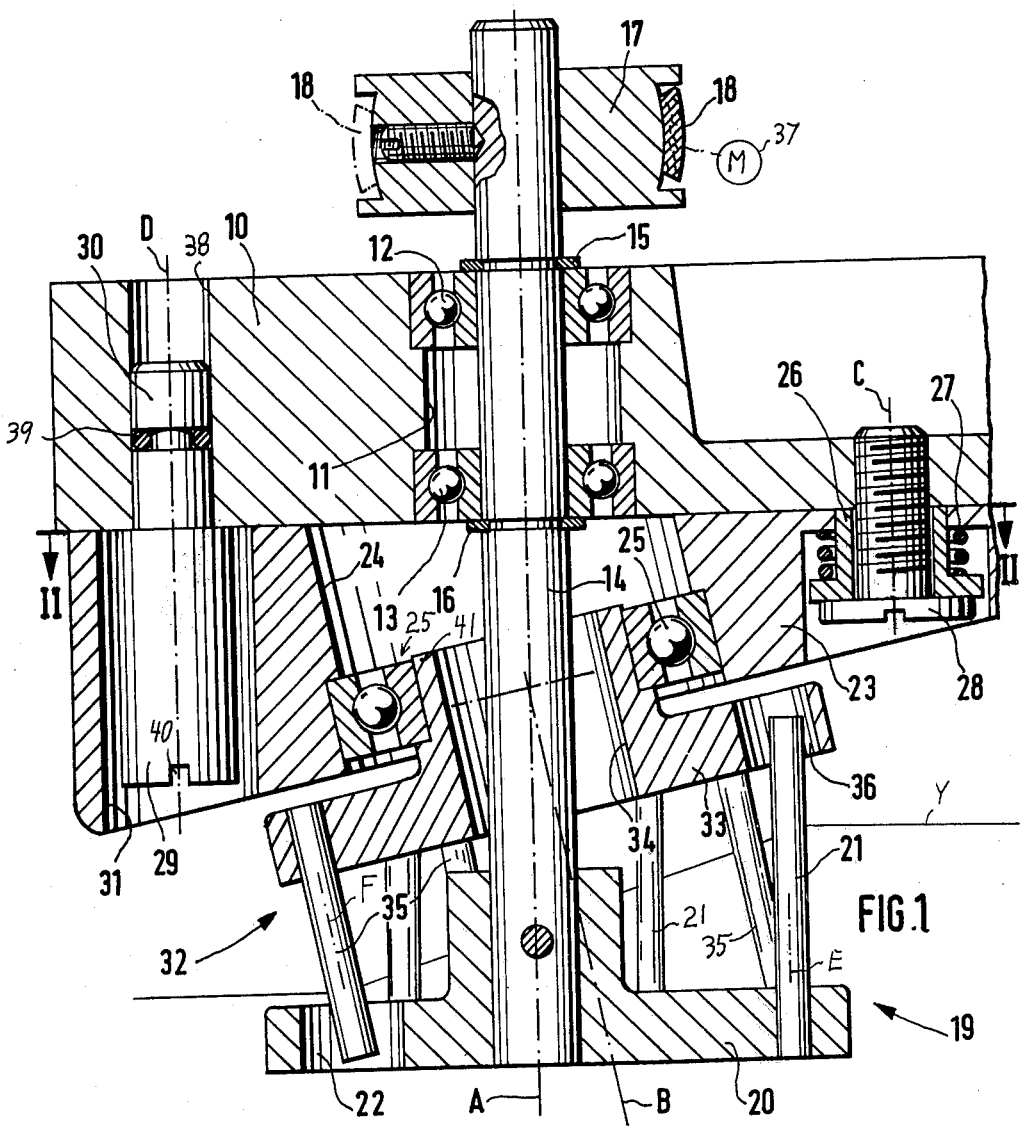
FIG. 1 is a vertical section through the apparatus according to this invention.

As shown in FIG. 1 a thick metal plate 10 mounted stationary constitutes a main base and is formed with a vertically throughgoing cylindrical hole 11 centered on an axis A and carrying the outer races of two axially spaced roller bearings 12 and 13 whose inner races are held on a shaft 14 by means of snap rings 15 and 16. Thus this shaft 14 can rotate on the plate 10 in the bearings 12 and 13 about the axis A. At its upper end the shaft 14 is screwed to a sheave 17 against whose surface can ride a flat drive belt 18 connected to a motor 37.

At its lower end the main support rod 14 carries a main support plate 20 on which is carried an array 19 of parallel rods 21 angularly equispaced about and parallel to the axis A. In this arrangement an odd number of such rods 21 is provided.

On the bottom face of the plate 10 there is mounted a base element 23 formed with a centrally throughgoing hole 24 through which passes the rod 14 and in which is provided a roller bearing 25 defining a skew rotation axis B extending at a small acute angle to the axis A. The base element 23 is pivotal in a T-profile sleeve 26 about an axis C parallel to the axis A on the base element 10. This sleeve 26 is secured by means of a machine bolt 28 to the plate 10 and a compression spring 27 bears between the head of the sleeve 26, and therefore the head of the bolt 28, and the lower surface of the element 23 so as to press it snugly against the lower surface of the element 10.

Figure 2:
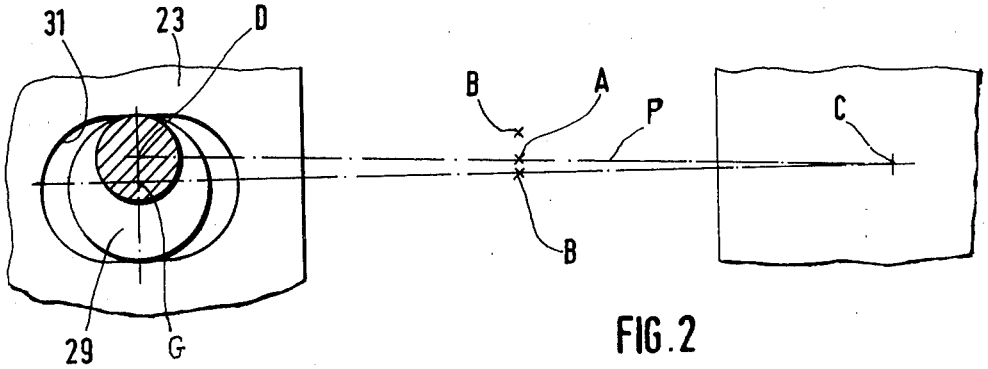
FIG. 2 is a largely diagrammatic sectional view taken along line II—II of FIG. 1.

On that side of the axis A opposite the pivot arrangement 26-28 there is provided an adjustment pin 30 received in a cylindrical bore 38 formed in the element 10 and defining therein an axis D parallel to the axis A and coplanar with the axes A and C. An O-ring 39 is provided for frictionally impeding rotation of the pin 30. An eccentric 29 best shown in FIG. 2 is formed on this pin 30 and has a screwdriver slot 40 and a central axis G offset from the axis D and parallel thereto. The element 23 is formed with a throughgoing hole 31 elongated in the direction of a plane P defined by the axes D, A and C and is of a width perpendicular to this plane P which is substantially equal to the diameter of the cylindrical eccentric 29. Thus rotation of the pin 30 and eccentric 29 will pivot the element 23 about the axis C so that the axis B will move from one side to the other of the plane P without changing the acute angle between axis A and axis B.

The bearing 25 which has its outer race mounted in the bore 24 has its inner race carried on a tubular extension 41 of a plate 33 carrying an array 32 of rods 35 which extend parallel to and are angularly equispaced around the axis B at which the plate 33 is formed with a hole 34. The free ends of the rods 35 which are interleaved with the rods 21 are loosely received in holes 22 formed in the plate 20 between the rods 21 and the free ends of the rods 21 are loosely received in holes 36 formed in the plate 33 between the rods 35.

When the motor 37 rotates the array 21 through the pulley 17, shaft 14, and plate 20 the rods 21 will therefore define a cylindrical orbit E centered on the axis A. The ends of the rods 21 and 35 which engage in the holes 22 and 36 will therefore rotationally entrain the array 32 so that it will define a cylindrical orbit F centered on the axis B. The orbits E and F are of like diameter.

In use a yarn Y is fed tangentially to the orbits E and F and is withdrawn tangentially therefrom. Since the two orbits E and F are not parallel to each other they will cause the yarn Y to shift axially along the rods 21 and 35 and will therefore prevent the turns of the yarn from chafing against one another.

Moreover since the holes 22 and 36 loosely receive the free ends of the rod 35 and 21, respectively, fouling of the system is unlikely. These throughgoing holes 22 and 36 are respectively self-cleaning since as the rods 35 and 21 work in these holes they will force therefrom any lint or the like that has built up therein.

The minimum spacing between the axes A and B is established by the position of the eccentric 29. Rotation of this eccentric 29 through 180° about the axis D so that its axis G is moved to the other side of the plane P will displace the axis B from the one side shown in FIG. 2 to the other side without changing the acute angle between axis A and axis B. Such displacement is normally accompanied by moving of the flat belt 18 from the solid-line position of FIG. 1 to the dot-dash line position of FIG. 1. Thus it is possible to adjust the arrangement for greater or lesser axial advance of the yarn Y along the orbits E and F.

It will be understood that each of the elements described above, or two or more together, may also find a useful application in other types of apparatus, differing from the types described above.

While the invention has been illustrated and described as embodied in a yarn feeder, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of advancing a filament comprising the steps of:

supporting a main array of main rods substantially parallel to and centered on a fixed main axis for rotation about said main axis;

driving said main array of main rods about said main axis rotationally so that said main rods define a substantially cylindrical main orbit centered on said main axis;

supporting a skew array of skew rods substantially parallel to and centered on a skew axis extending at an acute angle to said main axis for rotation about said skew axis with said skew rods interleaved with said main rods;

operatively engaging said skew rods with said main rods and thereby rotating said skew array about said skew axis so that said skew rods define a substantially cylindrical skew orbit inclined at an acute angle to said main orbit and centered on said skew axis;

displacing said skew axis pivotally about a support axis substantially parallel to said main axis without changing said acute angle;

feeding said filament tangentially to said orbits; and withdrawing said filament tangentially from said orbits.

2. The method defined in claim 1, wherein said main rods have ends turned toward said skew array, said skew array being operatively engaged by said ends for rotation of said skew array.

3. An apparatus for advancing a filament, said apparatus comprising:

a main bearing defining a fixed main rotation axis;

a main support rotatable in said main bearing about said main axis;

an annular main array of main rods centered on and generally parallel to said main axis;

a skew bearing defining a skew axis adjacent and inclined at an acute angle to said main axis;

a skew support rotatable in said skew bearing about said skew axis;

an annular skew array of skew rods centered on and generally parallel to said skew axis and interleaved with said main rods, said main rods being operatively rotationally engaged with said skew array;

means connected to said skew bearing for displacing said skew axis pivotally about a support axis substantially parallel to said main axis without changing said acute angle; and drive means for rotating said main support and said main rods about said main axis for displacement of said main rods in a generally cylindrical main orbit centered on said main axis and for rotating said skew support and said skew rods via said main rods for displacement of said skew rods in a generally cylindrical skew orbit centered on said skew axis and inclined to said main orbit, whereby a filament fed tangentially to and withdrawn tangentially from said orbits will be urged axially therealong.

4. The apparatus defined in claim 3, wherein the rods of one of said arrays have free ends spaced from the respective support, the support of the other array being formed with a plurality of openings each loosely receiving a respective one of said free ends, said ends bearing radially on said support of said other array to rotate same when said support of said one array is rotated about the respective axis.

5. The apparatus defined in claim 4, wherein both of said supports are formed with such openings and all of said rods have such ends.

6. The apparatus defined in claim 4, wherein said openings are throughgoing holes.

7. The apparatus defined in claim 3, wherein said means connected to said skew bearing includes an eccentric rotatable about a fixed axis parallel to said main axis.

8. The apparatus defined in claim 3; further comprising a main base carrying said main bearing and a skew base pivoted on said main base and carrying said skew bearing, said skew base being formed with a throughgoing hole at said main axis, said main support including a rod extending through said skew base at said hole.

9. The apparatus defined in claim 8; further comprising means including a spring for permitting limited displacement of said skew base relative to said main base.

10. The apparatus defined in claim 3, wherein each of said supports includes a respective shaft carried in the respective bearing and a plate extending perpendicular to the respective shaft and carrying the respective array.

11. The apparatus defined in claim 3, wherein said main and skew bearings both lie to the same axisl side of the respective main and skew arrays, said skew support being formed at said main and skew axes with a throughgoing hole, said main support including a rod extending along said main axis and passing through said hole without contact with said skew support.

12. The apparatus defined in claim 3 wherein said support axis lies outside said arrays.

* * * * *